US005983797A

United States Patent [19]

Secor

[11] Patent Number: 5,983,797

[45] Date of Patent: Nov. 16, 1999

[54] END SEAL ENGAGING BEARER OF ANILOX ROLLER ASSEMBLY

[75] Inventor: Howard C. Secor, Krum, Tex.

[73] Assignee: Howard W. DeMoore, Dallas, Tex.

[21] Appl. No.: 08/971,831

[22] Filed: Nov. 17, 1997

[51] Int. Cl.[6] ..... B41F 31/04

[52] U.S. Cl. ..... 101/350.6; 101/363; 101/169

[58] Field of Search ..... 101/363, 364, 101/366, 350.1, 350.6, 169, 167; 222/414, 578

[56] References Cited

U.S. PATENT DOCUMENTS

| | | | |
|---|---|---|---|
| Re. 35,471 | 3/1997 | Weishew | 101/208 |
| 3,135,197 | 6/1964 | Dutro et al. | 101/364 |
| 4,281,597 | 8/1981 | Dressler | 101/365 |
| 4,414,900 | 11/1983 | Kraus et al. | 101/363 |
| 4,432,282 | 2/1984 | Jurinak | 101/169 |
| 4,455,938 | 6/1984 | Loudon | 101/363 |
| 4,559,871 | 12/1985 | Kutzner et al. | 101/366 |
| 4,590,855 | 5/1986 | Schommer et al. | 101/350.6 |
| 4,796,528 | 1/1989 | Sarazen | 101/208 |
| 5,027,513 | 7/1991 | Allison, Jr. | 101/169 |
| 5,062,362 | 11/1991 | Kemp | 101/148 |
| 5,085,144 | 2/1992 | Lindstrom et al. | 101/363 |
| 5,150,651 | 9/1992 | Flores | 101/366 |
| 5,182,989 | 2/1993 | D'Heureuse et al. | 101/363 |
| 5,182,992 | 2/1993 | Rogge | 101/363 |
| 5,239,925 | 8/1993 | Bobo | 101/366 |
| 5,410,961 | 5/1995 | DeNicola et al. | 101/363 |
| 5,425,809 | 6/1995 | Person | 118/264 |
| 5,628,250 | 5/1997 | Weisbrod | 101/363 |
| 5,722,324 | 3/1998 | Nishiwaki et al. | 101/363 |

*Primary Examiner*—Edgar Burr
*Assistant Examiner*—Leslie J. Grohusky
*Attorney, Agent, or Firm*—Locke Liddell & Sapp LLP

[57] ABSTRACT

A roller assembly (10) is provided which includes an anilox roller (12) mounted with a head (14) for applying a liquid (18) to another surface, such as a delivery, printing plate blanket, or impression cylinder. An end dam (42) is provided at each end of the head (14), which defines a curved seal surface (46) which bears against the bearer surface (58) at each end of the anilox roller (12). The curved seal surface (46) and bearer surface (58) form an end seal for the roller assembly. If desired, lubrication can be provided between the curved seal surface (46) and the bearer surface (58).

18 Claims, 5 Drawing Sheets

END SEAL ENGAGING BEARER OF ANILOX ROLLER ASSEMBLY

TECHNICAL FIELD OF THE INVENTION

This invention relates to the printing industry, and in particular to an end seal for an anilox roller assembly to apply a liquid to a sheet or web press device such as a cylinder or the like.

BACKGROUND OF THE INVENTION

Anilox roller assemblies for applying a liquid to a cylinder are known. An example of one is found in U.S. Pat. No. 5,425,809, issued Jun. 20, 1995 to Steven M. Person. An anilox roller has a series of very precise depressions or dimples which permit a liquid, such as a coating or ink, to be applied to the roller as the surface of the roller passes through a reservoir of the liquid and then transfer a controlled amount of the liquid to another cylinder, such as a delivery, printing or blanket cylinder.

The fluid reservoir is defined within a head having a cavity. A portion of the outer surface of the anilox roller is inserted within the cavity. Doctor blades extend from the head into contact with the outer surface of the anilox roller to seal the reservoir along the length of the roller and control the amount of liquid removed from the reservoir as the anilox roller rotates. However, ends of the anilox roller assembly must also be sealed. In the past, such sealing has been achieved by felt, foam and other resilient or compressible seal materials. However, these seals have proven troublesome in service, often having to be replaced every day. The felt or foam becomes squashed and no longer has sufficient resiliency to perform an effective sealing function.

A need exists for a better sealing mechanism between the ends of the anilox roller and the reservoir head. This mechanism should be reliable and long-lasting, while being economical to manufacture and use.

SUMMARY OF THE INVENTION

In accordance with one aspect of the present invention, a roller assembly is provided which includes a roller mounted for rotation about an axis of rotation. A head is provided which defines a cavity therein for containing a fluid. A portion of the outer surface of the roller is positioned within the cavity. At least one end dam seal is mounted on the head. The seal defines a notch having a curved seal surface. The roller has an end bearer surface in contact with the curved seal surface of the end dam seal to form a seal at the end of the roller.

In accordance with another aspect of the present invention, a lubricating device is mounted on the head for providing a lubricant to the gap between the curved seal surface and the end bearer surface of the roller.

BRIEF DESCRIPTION OF THE DRAWINGS

A more complete understanding of the invention and its advantages will be apparent from the following detailed description when taken in conjunction with the accompanying drawings in which.

DETAILED DESCRIPTION OF THE INVENTION

Figure 1:
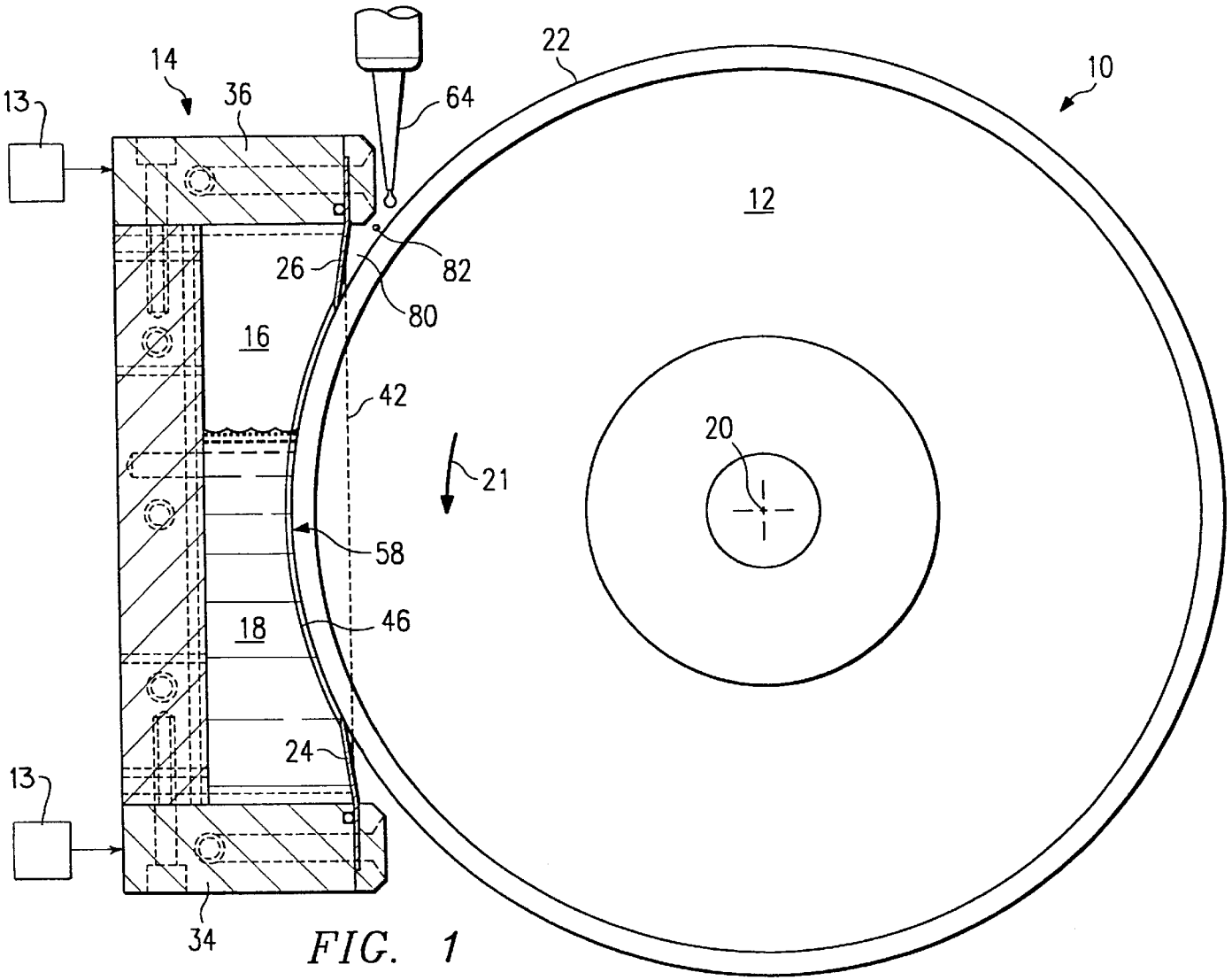
FIG. 1 is a side elevation sectional view of a roller assembly incorporating a first embodiment of the invention.

Referring now to the drawings wherein like reference characters designate like or corresponding parts throughout the several views, and in particular to FIG. 1, a roller assembly 10 forming a first embodiment of the present invention is illustrated. The roller assembly includes an applicator roller such as anilox roller 12 and a head 14 defining a reservoir 16 containing a liquid 18. As the anilox roller 12 rotates about its axis of rotation 20 in the direction of arrow 21, a portion of the cylindrical outer surface 22 of the anilox roller 12 moves into the reservoir 16 and is exposed to the liquid 18. As the anilox roller 12 continues to rotate, doctor blade 24 controls the quantity of liquid that remains on the outer surface of the anilox roller as it moves out of the reservoir.

The roller assembly 10 can be used in a sheet fed or web fed, rotary offset or flexographic printing press. In particular, it can be used to supply inks or protective and/or decorative coatings from the reservoir 16 to a delivery cylinder, plate cylinder, impression cylinder or a blanket cylinder, directly to the web or sheet, or to any other device within the press.

Figure 2:
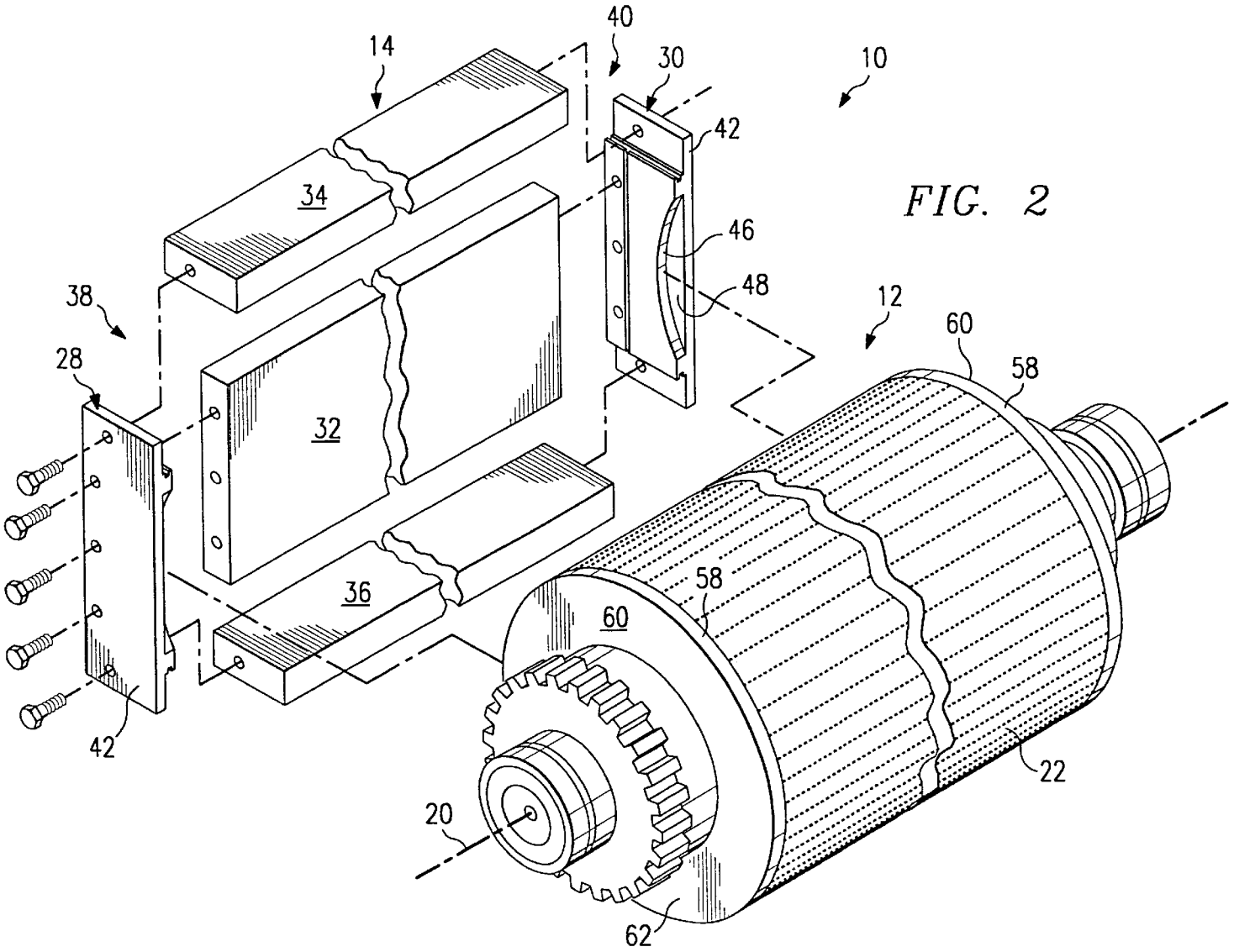
FIG. 2 is a perspective view of the head, with the head in partial disassembly, for use in applying liquid material to the anilox roller of FIG. 1.
Figure 3A:
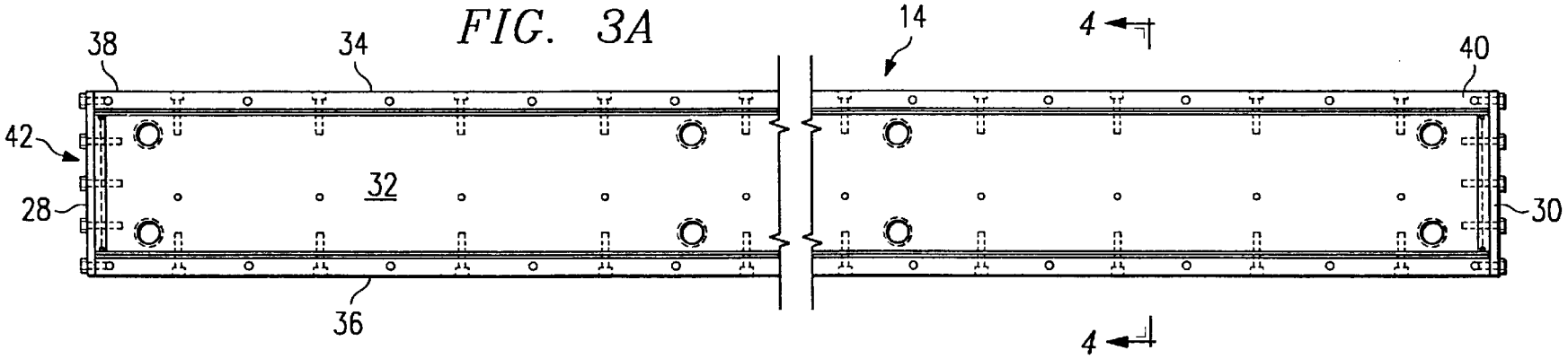
FIG. 3A is a plan view of the head used in the roller assembly seen from the roller engaging side.
Figure 4:
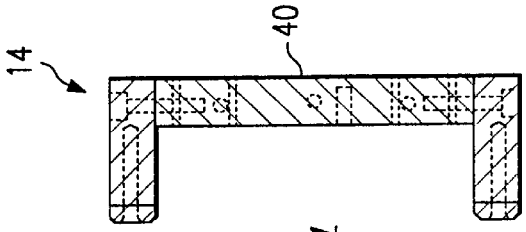
FIG. 4 is a transverse view of the head of FIGS. 3A and 3B taken on the line 4—4 of FIG. 3A.
Figure 3B:
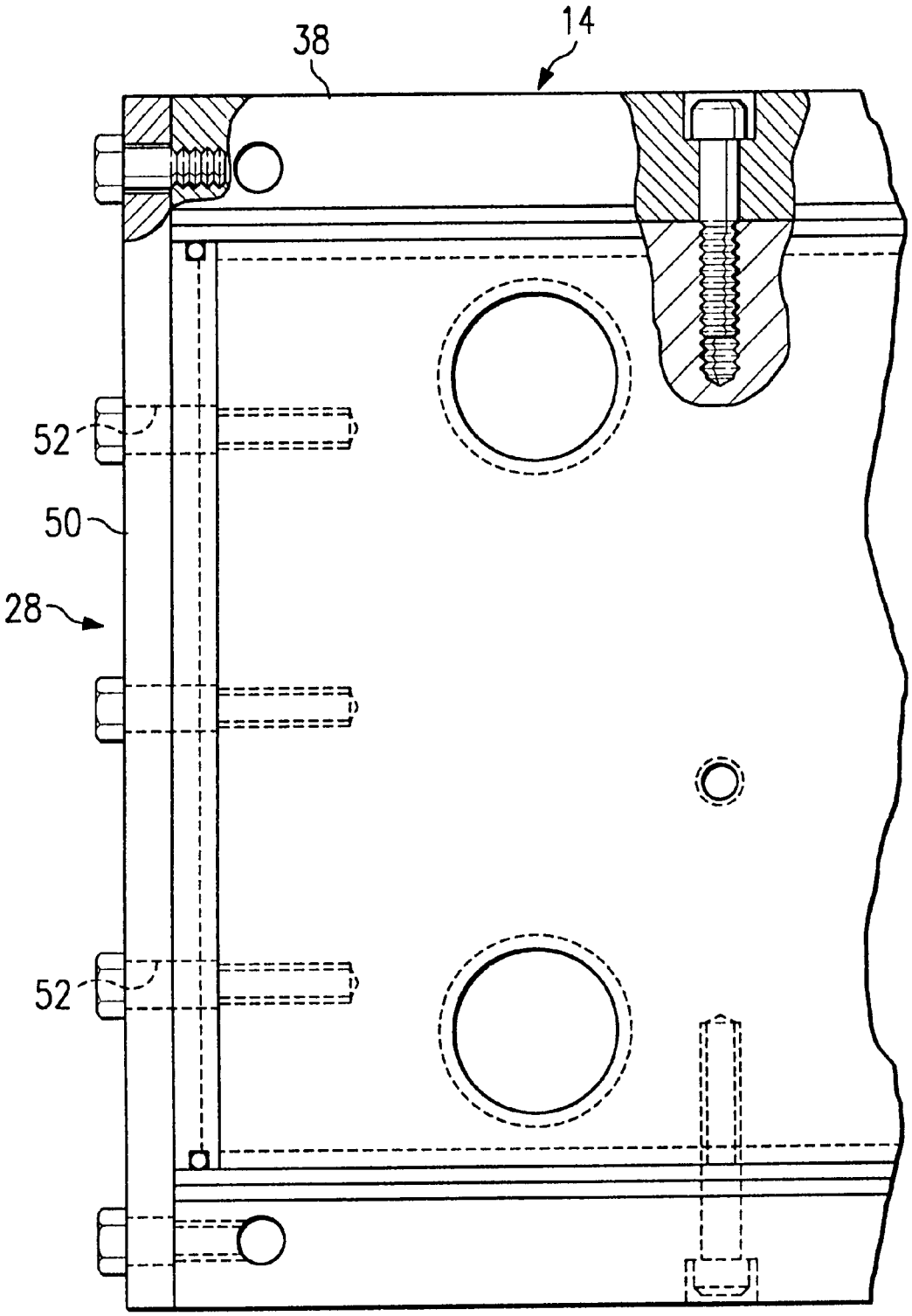
FIG. 3B is an enlarged partial plan view of head of FIG. 3A showing an end portion of the head.

With reference to FIG. 2, the anilox roller 12 is provided with an outer surface 22 engraved with an array of closely spaced shallow depressions referred as "cells". Ink or liquid coating material flows into the cells as the anilox roller turns within the reservoir 16. The anilox roller is also in contact with a delivery cylinder, plate cylinder, blanket cylinder or impression cylinder (not shown) to transfer the liquid 18 from the cells of the anilox roller over all or a portion of the surface of printed sheets or a web of material. At the ends 60 of the outer surface 22 are formed annular bearer surfaces 58.

The anilox roller can be constructed in various diameters and lengths and containing cells of various sizes and shapes. The volumetric capacity of an anilox roller is established during manufacturing and is dependent on the selection of cell size, shape and number of cells per unit area. Depending upon the intended application, the cell pattern may be fine (many small cells per square millimeter or inch) for lower coating weight jobs, for example UV coatings, or coarse (fewer large cells per square millimeter or inch) for applying a protective coating or an adhesive coating to heavy stock.

Preferably, the roller assembly 10 will be mounted for movement to retract away from the cylinder to which the liquid is transferred or engage the cylinder as needed. An example of such a construction is illustrated in U.S. Pat. No. 5,425,809 issued Jun. 20, 1995, said patent hereby being incorporated herein in its entirety. Air cylinders 13 or other suitable movement devices may be used to urge the roller 12 and head 14 together to provide a pre-determined engagement force between the curved seal surface and the outer surface on the roller.

As can be appreciated, the level of liquid 18 in the reservoir 16 must be maintained at a level sufficient to properly transfer the liquid to the cells within the exterior surface 22 of the anilox roller 12. Typically, a continuous supply of liquid is circulated through the reservoir 16 from external roller assembly 10 by the use of pumping mechanisms. An example is shown in U.S. Pat. No. 5,425,809 referenced above.

In order to prevent leakage of the liquid 18 from the roller assembly 10, a combination of seals is necessary, including the doctor blades 24 and 26 and end seals 28 and 30. The doctor blades 24 and 26 are conventional and well understood in the industry. However, the end seals 28 and 30 are an improvement over past designs which used compressible material such as felt and foam packing.

Figure 5:
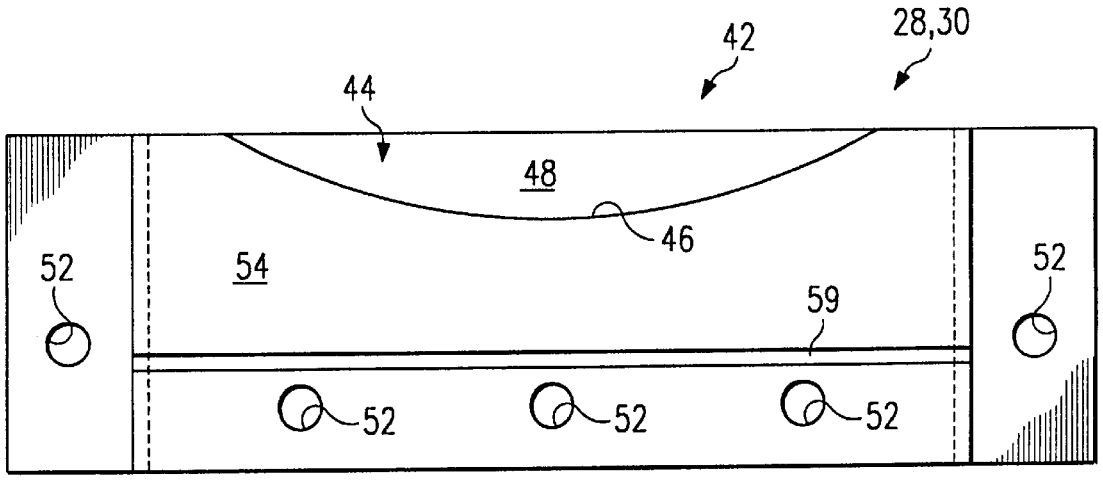
FIG. 5 is a plan view of the end dam seal used in the first embodiment of the invention.
Figure 6:
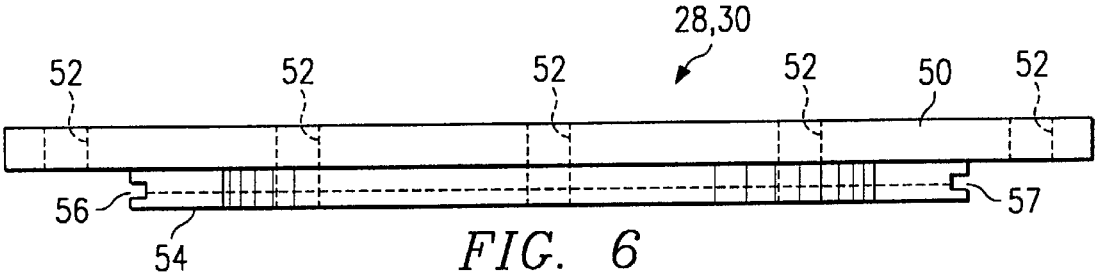
FIG. 6 is a top view of the end dam seal of FIG. 5.

With reference to FIGS. 1–6, the head 14 can be seen to include a back 32, a first side 34 and a second side 36. The doctor blades 24 and 26 are secured to the first side 34 and the second side 36, respectively. In addition, the head 14 defines a first end 38 and second end 40. At each end 38 and 40 is bolted an end dam 42 which forms a seal with the anilox roller at the ends of the roller assembly. With reference to FIGS. 5 and 6, each end dam 42 can be seen to include a notch 44 which defines a curved seal surface 46 and a planer surface 48. The end dam 42 also includes an end plate 50 with a plurality of apertures 52 to receive bolts to bolt the dams 42 at the ends 38 and 40 of the head 14. The portion 54 containing the notch 44 extends inwardly into the head 14 a distance from the end plate 50 and defines exterior o-ring seal grooves 56 and 57 to receive O-ring portions to seal against the first side 34 and second side 36, respectively and an o-ring groove 59 to receive an O-ring portion to seal against back 32 at ends 38 and 40 of the head 14.

With reference to FIG. 1, the curved seal surfaces 46 can be seen to be positioned in contact with the bearer surfaces 58 at the ends 60 of the anilox roller 12. The bearer surfaces 58 are a precision machined surface, normally acting to bear against a bearer surface on an adjacent roller. The curved seal surface 46 is similarly precision machined to provide consistent contact between the surface 46 and bearer surface 58 in normal operation to effectively create an end seal to prevent leakage from the reservoir 16 to exterior the roller assembly 10. In addition, the anilox roller has end portions 62 which extend generally perpendicular the rotational axis of the anilox roller. The planer surface 48 provides a close tolerance positioning of the anilox roller 12 at end portions 62 relative the head 14 along the axis of rotation 20.

The use of end dam seals 28 and 30 can be effective whether the cavity 16 is maintained at atmospheric pressure, a pressure slightly above atmospheric pressure, or a pressure below atmospheric pressure. However, the pressure in reservoir 16 is preferably kept at a slight vacuum relative to atmosphere of, for example, at least 5 inches (12.7 cm) of water less than atmospheric pressure, and preferably at about 10 (25.4 cm) inches of water. The vacuum will depend significantly on the type of liquid within the cavity 16 and relates to viscosity and other factors. For example, if water is used in the cavity 16, a vacuum of 5" (12.7 cm) of water less than atmospheric pressure would be recommended.

In the past, compressible seals such as felt and foam have permitted the anilox roller to be mounted further within the reservoir 16 than desired, causing excessive force to be exerted by the doctor blades on the anilox roller, forcing the doctor blades to wear very rapidly and also shorten the life of the anilox roller. It is possible, for example, for the anilox roller to be engaging the doctor blades so tightly that the blades last only 48 hours of operation. By use of a positive engagement between bearer surfaces 58 and seal surfaces 46, the anilox roller 12 cannot be moved further into reservoir 16 than desired, eliminating excessive wear on the doctor blades. By use of the planer surfaces 48, the anilox roller is also precisely oriented along its axis of rotation 20 relative the head 14.

In the past, when the seals at the end of the anilox roller were formed by felt or foam packing, the seals would squash down and fail and need changing relatively often, perhaps as often as every day. In the present invention, the bearer surfaces 58 of the anilox roller will ride on the curved seal surfaces 46, preventing leakage and providing a long term effective seal.

The engagement between the curved seal surface 46 and the bearer surface 58 of the anilox roller 12 should be lubricated. Certain liquids used in the printing industry, such as UV coating, have lubricating capabilities inherent therein. Thus, when applying a UV coating, for example, no separate lubrication is necessary between the curved seal surface 46 and the bearer surfaces 58. The coating itself will provide the necessary lubrication. When using other, non-lubricating liquids, such as an aqueous coating with poor rewetting, it is desirable to provide lubricating fluid between the curved seal surface 46 and the bearer surface 58. As seen in FIG. 1, a drip supply 64 can be provided above the gap 80 between the curved seal surface 46 and the bearer surface 58 to controllably drip a lubricating fluid therebetween. For example, one drop 82 every 30 seconds may be sufficient in operation. I have found suitable lubricants are, for example, propylene glycol and motor oil.

In the preferred embodiment, the end dams 42 are made out of bronze. However, other materials would be usable, including brass, plastics, other metals and the like.

Normally, the bearer surfaces 58 on the anilox roller are stainless steel. However, if the anilox roller is of ceramic (usually with an aluminum core), the surfaces 58 can be ceramic without the cells, thus providing a smooth curved surface to engage the curved seal surface 46. Anilox roller 12 can also be chrome plated, or even include a flexible material forming outer surface 22 and/or bearer surface 58 such as plastic, rubber composition or other flexible material.

Figure 7:
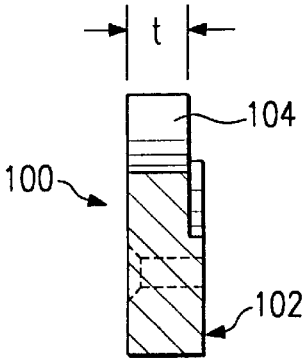
FIG. 7 is an end view of an end dam seal used in a second embodiment of the invention, taken on the line 7—7 in FIG. 8.
Figure 8:
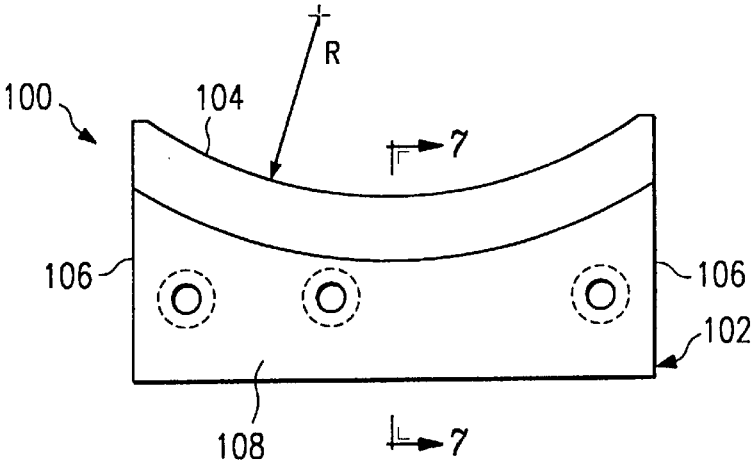
FIG. 8 is a plan view of the end dam seal of FIG. 7.

With reference to FIGS. 7 and 8, a second embodiment of the present invention is illustrated as end seal 100 which includes an end dam 102. End dam 102 is similar in function to end dam 42 but does not include the notch 44 or surface 48. The curved seal surface 104 extends across substantially the entire thickness t of the end dam 102. Thus, end dam 102 does not act to position the anilox roller 12 along its axis of rotation. However, a pair of end dams 102 will be used with a head 14, with an end dam at each end thereof to seal against the bearer surfaces 58 at the ends of the anilox roller 12. The ends 106 and the bottom 108 of each end dam 102 are sealed only to the mating portions of the head 14 by relatively tight tolerances. O-rings typically are not necessary, although seal material such as O-rings can be used if desired. By maintaining a slight negative pressure within the reservoir 16, no significant leakage will occur between the end dams 102 and the remainder of head 14.

In addition, while not preferred, it would be possible to have the curved seal surface 104 seal against the outer surface 22 of the anilox roller 12 in an area where the surface has the cells formed therein. This creates the possibility of moving an end dam 102 within the confines of the head 14 to, for example, separate the reservoir 16 into two or more compartments along the axis of rotation 20 for multiple color application. Further, a head 14 could be used with an anilox roller that is longer along the axis of rotation than the head 14, if necessary, with the curved seal surfaces 104 of the end dams 102 in sealing engagement with the outer surface 22 of the analox roller 12 a distance inward from the ends of the anilox roller 12 determined by the relative lengths of the head 14 and anilox roller 12. The end dams 42 could be used in a similar manner but it would be necessary to remove sufficient portions of end plate 50 to fit the roller being used, as by removing notch 44 and surface 48.

In one end dam seal constructed in accordance with the teachings of the present invention, the thickness t is about 7.6 mm (3/10 inch) and the radius R of the seal surface 104 is the same radius as the bearer surface on the anilox roller with which it is used within a tolerance of about ±0.025 mm (±0.001 inch).

Although several embodiments of the present invention have been illustrated in the accompanying drawings and described in the foregoing detailed description, it will be understood that the invention will not be limited to the embodiments disclosed, but is capable of numerous rearrangements, modifications and substitutions of parts and elements without departing from the scope and spirit of the invention.

We claim:

1. A roller assembly, comprising:

a roller having bearer surfaces at each end mounted for rotation about an axis for rotation and having an outer surface;

a head defining a cavity therein for containing a liquid, a portion of the outer surface of the roller extending into the cavity;

at least one non-compressible end dam seal mounted to the head and defining a notch having a curved seal surface, the curved seal surface engaging a bearer surface of the roller to form an end seal.

2. The roller assembly of claim 1 wherein the end dam seal is made of bronze.

3. The roller assembly of claim 1 wherein the notch in the non-compressible end dam seal further defines a planar surface, said planar surface extending generally perpendicular to the axis of rotation of the roller, the roller having an end portion, said end portion adjacent the planar surface to provide for positioning of the roller relative the head.

4. The roller assembly of claim 1 wherein the roller is an anilox roller.

5. The roller assembly of claim 1 wherein first and second doctor blade are mounted on the head and engage the outer surface of the roller.

6. The roller assembly of claim 1 further having a second non-compressible end dam seal mounted on the head, the non-compressible end dam seals being mounted at each end of the head, the second non-compressible end dam seal having a notch defining a curved seal surface in sealing engagement with the outer surface on the roller.

7. The roller assembly of claim 1 wherein the non-compressible end dam seal has a back portion and an inner portion, an o-ring seal groove being formed about the inner portion.

8. The roller assembly of claim 1 wherein the non-compressible end dam seal is bolted to the head.

9. The roller assembly of claim 1 wherein the non-compressible end dam seal is positioned so that only a limited portion of the outer surface of the roller extends into the cavity.

10. The roller assembly of claim 1 further having a lubrication mechanism to provide a lubricant to a gap formed between the outer surface of the roller and the curved seal surface of the non-compressible end dam seal.

11. The roller assembly of claim 1 wherein the liquid within the cavity provides lubrication between the curved seal surface of the non-compressible end dam seal and the outer surface of the roller.

12. The roller assembly of claim 1 further comprising a means for urging the roller and the head together to provide a pre-determined engagement force between the curved seal surface and the outer surface on the roller.

13. A roller assembly, comprising:

an anilox roller mounted for rotation about an axis for rotation and having an outer surface, the anilox roller having ends defining bearer surfaces;

a head defining a cavity therein for containing a liquid, a portion of the outer surface of the anilox roller extending into the cavity;

a non-compressible end dam seal mounted at each end of the head, each end dam seal defining a notch having a curved seal surface, the curved seal surface engaging the bearer surface of the anilox roller to form an end seal.

14. The roller assembly of claim 13, wherein each non-compressible end dam seal is bolted to the head.

15. The roller assembly of claim 13 wherein the non-compressible end dam seals are made of bronze.

16. The roller assembly of claim 13 wherein each non-compressible end dam seal has a back portion and an inner portion; an o-ring seal groove being formed in the inner portion to seal against the head.

17. The roller assembly of claim 13, further having a lubrication mechanism to provide a lubricant to a gap formed between the bearer surface of the anilox roller and the curved seal surface of each non-compressible end dam seal.

18. The roller assembly of claim 17 wherein the lubricant is propylene glycol or motor oil.

* * * * *